US012628949B2

(12) United States Patent
Lee

(10) Patent No.: US 12,628,949 B2
(45) Date of Patent: May 19, 2026

(54) STRUCTURE FOR ASSEMBLY TYPE FURNITURE

(71) Applicant: Won Kyung Lee, Suwon-si (KR)

(72) Inventor: Won Kyung Lee, Suwon-si (KR)

( * ) Notice: Subject to any disclaimer, the term of this patent is extended or adjusted under 35 U.S.C. 154(b) by 0 days.

(21) Appl. No.: 18/866,597

(22) PCT Filed: Apr. 12, 2023

(86) PCT No.: PCT/KR2023/004940
§ 371 (c)(1),
(2) Date: Nov. 18, 2024

(87) PCT Pub. No.: WO2023/224267
PCT Pub. Date: Nov. 23, 2023

(65) Prior Publication Data

US 2025/0255410 A1 Aug. 14, 2025

(30) Foreign Application Priority Data

May 18, 2022 (KR) ..... 10-2022-0060870

(51) Int. Cl.
*A47B 87/00* (2006.01)

(52) U.S. Cl.
CPC .... *A47B 87/007* (2013.01); *A47B 2230/0018* (2013.01)

(58) Field of Classification Search
CPC . A47B 87/007; A47B 2230/0018; E04C 1/00; A63H 33/107; A63H 33/108;
(Continued)

(56) References Cited

U.S. PATENT DOCUMENTS 2,565,065 A * 8/1951 Chakeres ..... F16B 5/06 403/336
3,577,105 A * 5/1971 Jones, Jr. ..... H01P 1/042 403/339

(Continued)

FOREIGN PATENT DOCUMENTS

CN 208850914 U 5/2019
JP 2004-132472 A 4/2004

(Continued)

OTHER PUBLICATIONS

International Search Report dated Jul. 26, 2023 in International Application No. PCT/KR2023/004940.

(Continued)

*Primary Examiner* — Daniel J Troy
*Assistant Examiner* — Timothy M Ayres
(74) *Attorney, Agent, or Firm* — KORUS Patent, LLC; Seong Il Jeong

(57) ABSTRACT

The present invention relates to a structure for assembly type furniture and, in particular, to a structure for assembly type furniture comprising: a main block having a bar shape and disposed in the transverse direction, having first coupling protrusions protruding from the top surface thereof, and having first coupling grooves formed on the bottom surface thereof corresponding to the first coupling protrusions, such that various types of assembly type furniture having robustness can be manufactured by easily fastening the blocks stacked one upon another by means of bolts, etc., wherein the first coupling groove is formed on one side of a point where the first coupling protrusion is formed, and at least one first coupling protrusion and at least one first coupling groove are alternately formed such that a plurality of main blocks may be stacked in a manner in which the first
(Continued)

coupling protrusions are fitted into the first coupling grooves.

4 Claims, 12 Drawing Sheets

(58) Field of Classification Search
CPC .... A63H 33/12; A63H 33/086; A63H 33/062; A63H 33/101
USPC ..... 312/107; 446/120, 128, 85, 116, 122; 52/592.6
See application file for complete search history.

(56) References Cited

U.S. PATENT DOCUMENTS 3,611,609 A * 10/1971 Reijnhard ..... A63H 33/101 446/128
3,862,809 A * 1/1975 Bodner ..... F16B 12/20 403/231
3,926,529 A * 12/1975 Brooks ..... F16B 12/24 52/285.4
3,940,212 A * 2/1976 Gutner ..... F16B 12/14 206/231
3,999,878 A * 12/1976 Robinson ..... F16B 12/46 403/231
4,497,093 A * 2/1985 Haberkorn ..... F16B 12/26 24/615
4,589,792 A * 5/1986 Niziol ..... F16B 12/14 403/231
4,973,187 A * 11/1990 Sauder ..... F16B 12/46 403/231
5,015,117 A * 5/1991 Pawlicki ..... E04G 17/02 249/7
5,472,269 A * 12/1995 Novikoff ..... A47B 21/00 312/265.5
5,775,046 A 7/1998 Fanger et al.
7,736,211 B2 * 6/2010 Marzetta ..... A63H 33/106 446/85
7,967,656 B2 * 6/2011 Hu ..... A63H 33/10 446/124
8,033,537 B2 * 10/2011 Wuethrich ..... F16B 5/02 446/124
8,087,364 B2 * 1/2012 Huang-Jung ..... F16B 5/065 108/56.1
8,641,315 B2 * 2/2014 Liu ..... F16B 12/26 403/353
9,816,541 B2 * 11/2017 Bilis ..... F16B 12/22
10,617,969 B2 * 4/2020 Landau ..... A63H 33/107
2014/0294498 A1 * 10/2014 Logan ..... A47B 47/042 403/376
2023/0225506 A1 * 7/2023 Daraiy ..... A63H 33/04 248/558

FOREIGN PATENT DOCUMENTS

JP 2005-344337 A 12/2005
JP 2011-67511 A 4/2011
JP 2015-211795 A 11/2015
KR 1992-0004732 Y1 7/1992
KR 20-0400173 Y1 11/2005
KR 10-2011-0110065 A 10/2011
KR 10-1386209 B1 4/2014
KR 10-2058363 B1 1/2020
WO 2010/023404 A2 3/2010
WO 2017/118957 A1 7/2017

OTHER PUBLICATIONS

Decision to Grant dated Jun. 25, 2024 in Korean Application No. 10-2022-0060870.

* cited by examiner (a)

(b)

(a)

(b)

(a)

(b)

STRUCTURE FOR ASSEMBLY TYPE FURNITURE

CROSS-REFERENCE TO RELATED APPLICATIONS

This application is the U.S. national stage application of International Patent Application No. PCT/KR2023/004940, filed Apr. 12, 2023, which claims the benefit under 35 U.S.C. § 119 of Korean Application No. 10-2022-0060870, filed May 18, 2022, the disclosures of each of which are incorporated herein by reference in their entirety.

TECHNICAL FIELD

The present disclosure relates to a structure for assembly-type furniture. More particularly, the present disclosure relates to a structure for assembly-type furniture, the structure being configured such that assembly-type furniture having various types and being capable of maintaining a rigid assembled state is capable of being manufactured.

BACKGROUND ART

Generally, furniture such as bookcases, storage cabinets, and so on are manufactured and assembled in a predetermined shape. Therefore, when a user is tired of the furniture or a part of the furniture is damaged, the furniture is usually discarded and new furniture is purchased, which causes excessive expenditure as well as waste of resources.

In order to solve this problem, in Korean Patent No. 10-2058363 (hereinafter, referred to as the 'cited invention'), a technology of manufacturing various types of furniture by manufacturing a plurality of standardized blocks and then assembling the manufactured blocks together is disclosed. An assembly block disclosed in the cited invention 1 is formed such that the assembly block has the same/similar structure as LEGO blocks, and may be assembled vertically by using a plurality of fitting protrusion parts formed on an upper portion of the assembly block. Specifically, the fitting protrusion part formed on the upper portion of the assembly block positioned at a lower side among the assembly blocks that are vertically assembled is fitted such that the fitting protrusion part is positioned at a point corresponding to the fitting protrusion part formed on the upper portion among fitting groove parts recessed upward from a lower portion of the assembly block positioned at an upper side.

When assembly-type furniture is manufactured by using such an assembly block, the assembly blocks are coupled to each other with simple fitting-coupling, so that robustness is reduced. Furthermore, in coupling the assembly blocks disposed vertically, the fitting protrusion parts at the upper side and the lower side are positioned at the same points, so that there is a problem that fixing the assembly blocks by using a bolt and so on is difficult.

DISCLOSURE

Technical Problem

Accordingly, the present disclosure has been made keeping in mind the above problems occurring in the related art, and an objective of the present disclosure is to provide a structure for assembly-type furniture, the structure being configured such that vertically stacked blocks are capable of being easily fixed to each other by using a bolt and so on so that assembly-type furniture of various types and robustness are capable of being manufactured.

Technical Solution

In order to achieve the objective described above, according to the present disclosure, there is provided a structure for assembly-type furniture, the structure including a main block formed in a bar shape and disposed in a transverse direction, the main block having a first coupling protrusion that protrudes from an upper surface of the main block, and the main block having a first coupling groove which is formed in a shape corresponding to that of the first coupling protrusion and which is recessed from a lower surface of the main block, wherein, in the main block, the first coupling groove may be formed in one side of a point where the first coupling protrusion is formed, and at least one first coupling protrusion and at least one first coupling groove may be alternately formed in the main block, so that a plurality of main blocks is capable of being stacked in a manner in which the first coupling protrusion is fitted into the first coupling groove.

In addition, the structure may further include a fixing bolt which passes through the upper surface of the main block and which is fastened to the first coupling protrusion of another main block fitted into the first coupling groove, the upper surface corresponding to the first coupling groove, wherein, in the main block, a receiving groove in which a head part of the fixing bolt is positioned therein may be recessed from a point of the upper surface of the main block corresponding to the first coupling groove, so that the fixing bolt does not protrude from the upper surface of the main block.

In addition, the structure may further include an auxiliary fastening member which includes a second coupling protrusion part formed in a shape same as that of the first coupling protrusion and configured to be positioned on the upper surface of the main block and which includes a second pin part which extends downward from the second coupling protrusion part and which passes through a fixing hole where the fixing bolt is capable of passing therethrough.

In addition, the structure may further include a finishing block having a third coupling groove which corresponds to the first coupling protrusion and which is recessed from a lower surface of the finishing block or having a third coupling hole formed through the finishing block.

In addition, the structure may further include a base plate configured such that the plurality of main blocks is capable of being stacked on an upper side of the base plate while the plurality of main blocks is in a fixed state.

Advantageous Effects

According to the present disclosure, since the plurality of main blocks is capable of being stacked vertically in a manner that the first coupling protrusion is fitted into the first coupling groove, various types of assembly-type furniture are capable of being manufactured, and robustness is capable of being realized as at least one first coupling protrusion and at least one first coupling groove are alternately formed and the main blocks are stacked vertically in a staggered manner.

In addition, since the fixing bolt is fastened to the first coupling protrusion fitted into the first coupling groove without the head part of the fixing bolt protruding from the upper surface of the main block, secondarily fixing is capable of being realized by the fixing bolt having a short length, so that robustness may further be increased.

In addition, as the auxiliary fastening member, the finishing block, the base plate, and so on are additionally used, various types of assembly-type furniture are capable of being manufactured.

MODE FOR INVENTION

In the present disclosure, a structure for assembly-type furniture is proposed, the structure being configured such that blocks which are vertically stacked are capable of being easily fixed by using a bolt and so on so that various types of assembly-type furniture having robustness are capable of being manufactured. The structure includes a main block formed in a bar shape and disposed in a transverse direction, the main block having a first coupling protrusion that protrudes from an upper surface of the main block, and the main block having a first coupling groove which is formed in a shape corresponding to that of the first coupling protrusion and which is recessed upward from a lower surface of the main block. In the main block, the first coupling groove is formed in one side of a point where the first coupling protrusion is formed, and at least one first coupling protrusion and at least one first coupling groove are alternately formed, so that a plurality of main blocks is capable of being stacked in a manner in which the first coupling protrusion is fitted into the first coupling groove.

The scope of claims of the present disclosure is not limited to embodiments described below, and may be variously modified by those skilled in the art within the scope of the technical gist of the present disclosure.

Hereinafter, a structure for assembly-type furniture of the present disclosure will be described in detail with reference to FIG. 1A to FIG. 13.

A structure for assembly-type furniture of the present disclosure includes a main block 100 including a plurality of main blocks 100 which is configured to be stacked and which is capable of forming a floor, a wall body, and so on of furniture according to a placement direction thereof.

As illustrated in FIG. 1A to FIG. 3, the main block 100 is formed in a bar shape and is disposed in a transverse direction and, as an example, the main block 100 may be formed in a rectangular column shape and may be disposed horizontally. Such a main block 100 disposed in the transverse direction has a first coupling protrusion 110 that protrudes from an upper surface of the main block 100. The first coupling protrusion 110 may be formed in various shapes, but may be formed in a column shape having a diameter (width) smaller than a width of the main block 100. Furthermore, it is preferable that the first coupling protrusion 110 is formed such that the first coupling protrusion 110 has a height shorter than a height of the main block 100. At least one such a first coupling protrusion 110 may be formed. When a plurality of first coupling protrusions 110 is formed, the plurality of first coupling protrusions 110 may be formed such that the plurality of first coupling protrusions 110 is spaced apart from each other by a predetermined distance along a longitudinal direction of the main block 100.

Figure 1A:
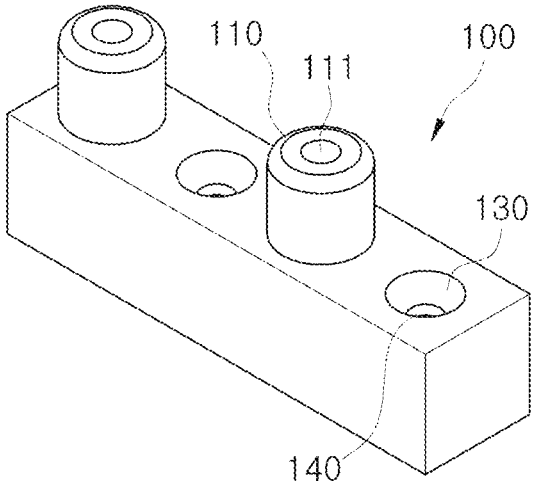
FIGS. 1A and 1B show a structure of a main block applied to a structure for assembly-type furniture of the present disclosure.
Figure 1B:
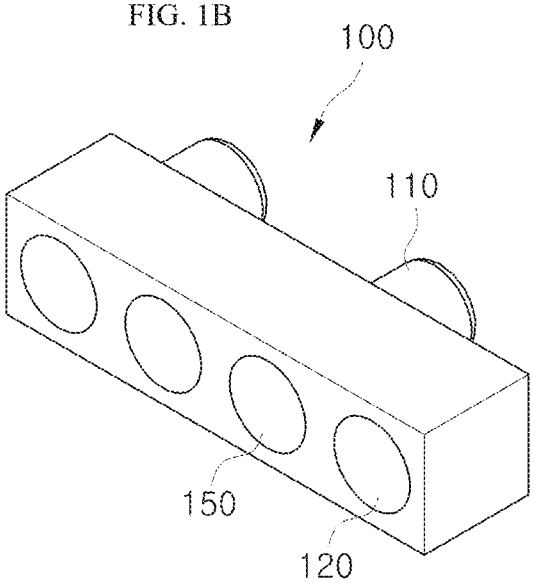

In addition, the main block 100 has a first coupling groove 120 which is formed in a shape corresponding to that of the first coupling protrusion 110 and which is recessed upward from a lower surface of the main block 100. Particularly, the first coupling groove 120 in the present disclosure is formed in one side of a point where the first coupling protrusion 110 is formed. Therefore, in the main block 100, as illustrated in FIGS. 1A and 1B, at least one first coupling protrusion 110 and at least one first coupling groove 120 are alternately formed.

The first coupling protrusion 110 and the first coupling groove 120 may be formed in the same number, or may be formed such that any one of the first coupling protrusion 110 and the first coupling groove 120 are one more than the other. However, in forming a flow, a wall body, and so on of furniture, where a large number of main blocks 100 are used, it is preferable that the first coupling protrusion 110 and the first coupling groove 120 are formed in the same number. For example, in the main block 100, two first coupling protrusions 110 and two first coupling grooves 120 may be alternately formed.

Figure 2A:
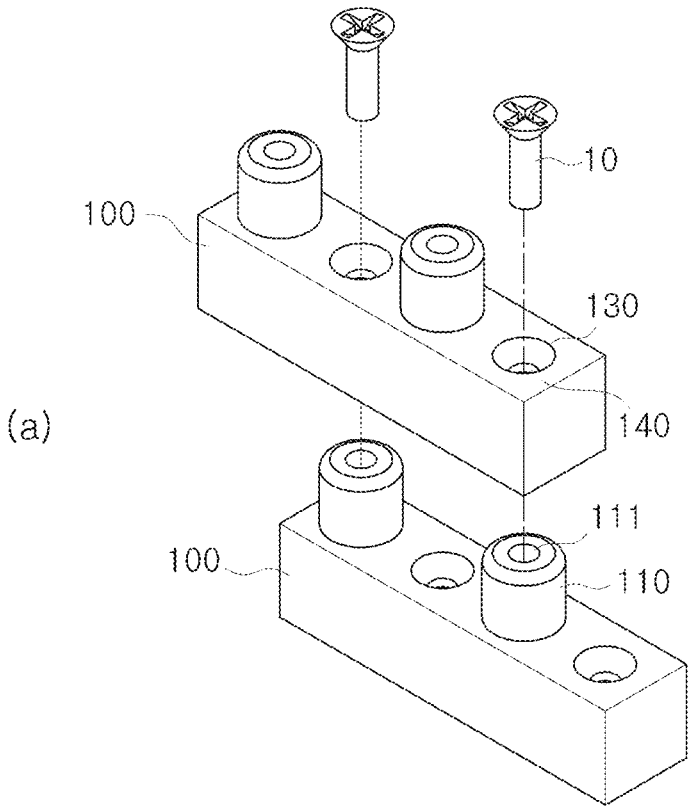
FIGS. 2A and 2B show a process in which each main block applied to the structure for assembly-type furniture of the present disclosure is stacked and fastened by a fixing bolt.
Figure 2B:
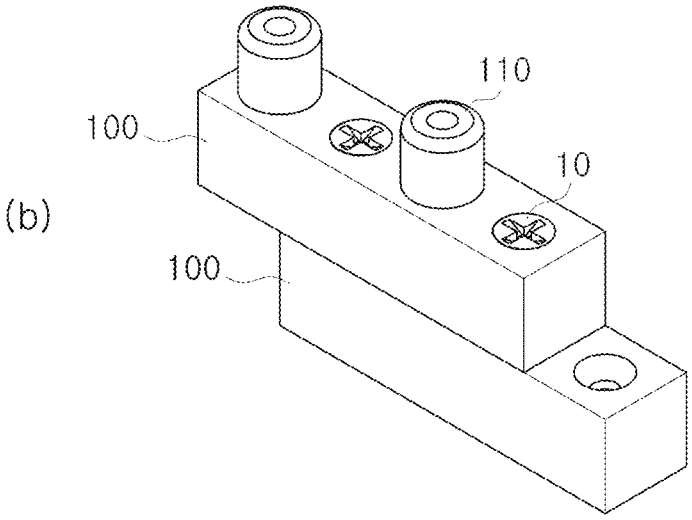
Figure 3:
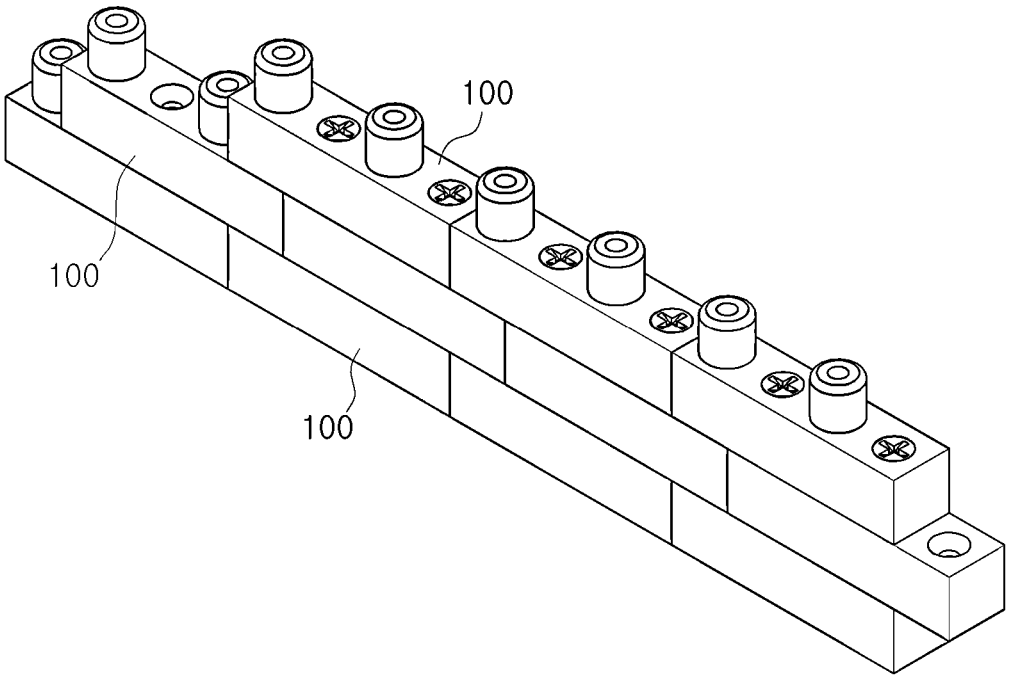
FIG. 3 is a view illustrating a state in which each main block applied to the structure for assembly-type furniture of the present disclosure is stacked.

As illustrated in FIGS. 2A, 2B, and 3, the main block 100 as described above is capable of being used for forming a floor, a wall body and so on in manufacturing various types of assembly-type furniture since the plurality of main blocks 100 is capable of being stacked vertically in a manner in which the first coupling protrusion 110 is fitted into the first coupling groove 120, and has robustness since the plurality of main blocks 100 is stacked vertically in a staggered manner.

As such, the plurality of main blocks 100 stacked vertically primarily has a fixing force by a forcible fitting between the first coupling protrusion 110 and the first coupling groove 120. Therefore, in order to further increase the fixing force, the main block 100 positioned above and the adjacent main block 100 positioned below may be coupled to each other by a bolt. As an example, as illustrated in FIGS. 2A and 2B, the present disclosure may further include a fixing bolt 10 which passes through the upper surface of the main block 100 and which is fastened to another first coupling protrusion 110 fitted into the first coupling groove 120, the upper surface corresponding to the first coupling groove 120.

At this time, the main block 100 may have a receiving groove 130 in which a head part of the fixing bolt 10 is positioned therein and which is recessed from a point of the upper surface of the main block 100 corresponding to the first coupling groove 120, and a fixing hole 140 where the fixing bolt 10 passes therethrough may be formed on a center part of the receiving groove 130. It is preferable that the receiving groove 130 is formed such that the head part of the fixing bolt 10 coupling the main blocks 100 vertically stacked does not protrude from the upper surface of the main block 100 positioned above, so that the main blocks 100 vertically stacked are capable of being coupled to each other in close contact. In addition, in a point corresponding to the fixing hole 140, i.e., a center part of the first coupling protrusion 110, a fastening hole 111 into which the fixing bolt 10 is capable of being fitted along a longitudinal direction of the fastening hole 111 may be formed, and the fixing bolt 10 may be screw-coupled to the fastening hole 111.

Therefore, the fixing bolt 10 may have a length smaller than the height of the first coupling protrusion 110. Furthermore, in a state in which the first coupling protrusion 110 formed on the main block 100 positioned below is fitted into the first coupling groove 120 formed in the main block 100 positioned above, the fixing bolt 10 passes through the upper surface of the main block 100 positioned above and then is fastened to the first coupling protrusion 110 that is inserted into the first coupling groove 120, so that a secondarily fixing is capable of being realized by the fixing bolt 10 having the small length.

In addition, as illustrated in FIGS. 1A and 1B, the main block 100 may have an auxiliary coupling groove 150 which is formed in a shape corresponding to that of the first coupling protrusion 110 and which is recessed from a point of the lower surface of the main block 100, the point of the lower surface corresponding to the first coupling protrusion 110. The auxiliary coupling groove 150 may be used for coupling the main block 100 to an auxiliary fastening member 200, a base block 600, and so on to be described later.

Meanwhile, during a process of manufacturing various types of furniture, such as another main block 100 in which the first coupling groove 120 is formed may be stacked on an upper side of a point of one main block 100, the point having the first coupling groove 120. At this time, in order to rigidly fix one main block 100 to another main block 100, the auxiliary fastening member 200 may be used.

Figure 4A:
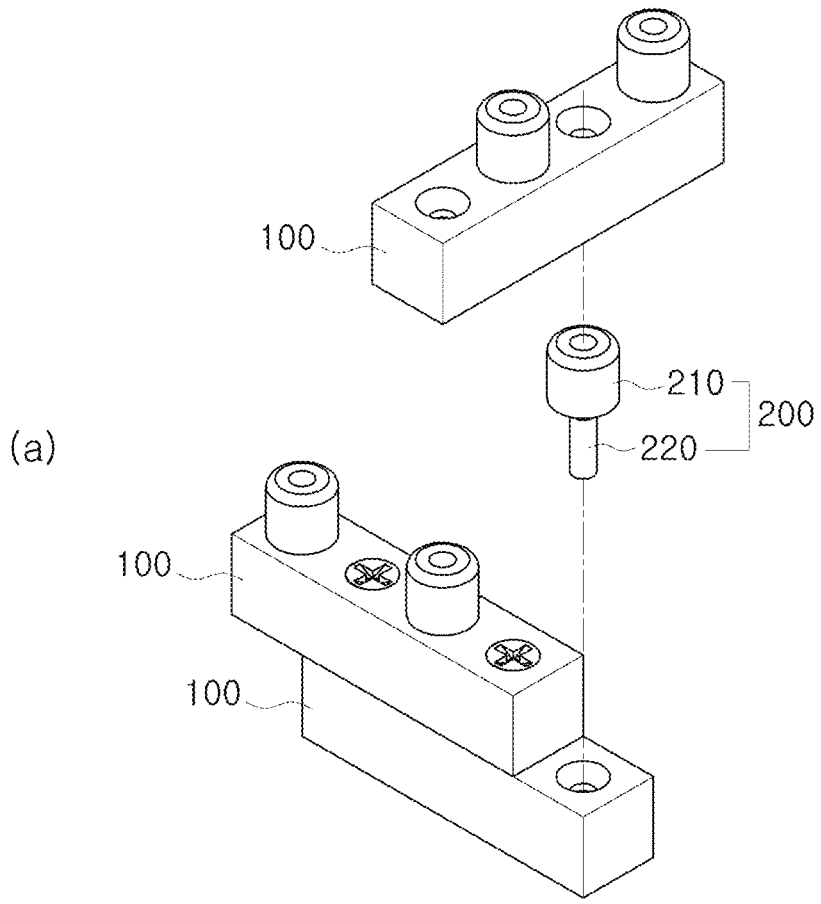
FIGS. 4A and 4B show a process in which each main block is stacked by an auxiliary fastening member applied to the structure for assembly-type furniture of the present disclosure.
Figure 4B:
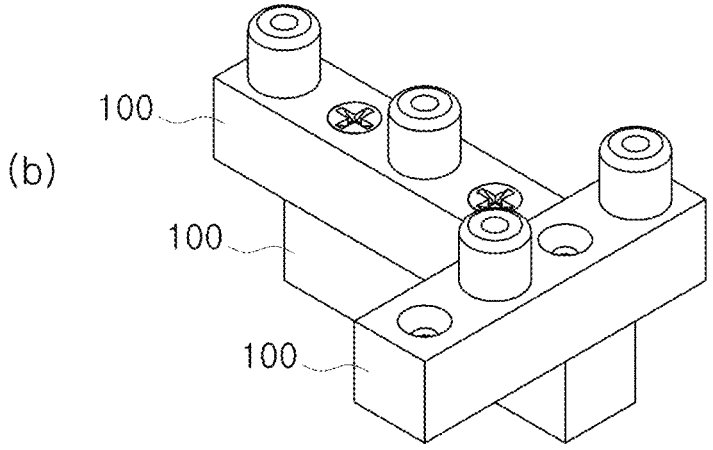

As an example, as illustrated in FIGS. 4A and 4B, the auxiliary fastening member 200 may include a second coupling protrusion part 210 formed in a shape same as that of the first coupling protrusion 110 and configured to be positioned on the upper surface of the main block 100, and may include a second pin part 220 which extends downward from the second coupling protrusion part 210 and which passes through the fixing hole 140. For example, the auxiliary fastening member 200 is mounted such that the second pin part 220 passes through the fixing hole 140 formed in one main block 100 and the second coupling protrusion part 210 protrudes from the upper surface of one main block 100, so that the first coupling groove 120 of another main block 100 is capable of being coupled to the second coupling protrusion part 210.

In the present disclosure, when a floor, a wall body, and so on are formed by stacking the plurality of main blocks 100, a state in which the first coupling protrusion 110 of the main block 100 at the uppermost side protrudes from the upper surface of the main block 100 is realized. Therefore, as illustrated in FIGS. 5A, 5B, and 6, in order to realize a neat external appearance, the present disclosure may further include a finishing block 300 and/or a finishing plate 400.

For example, it is preferable that the finishing block 300 is formed in a bar shape, is disposed in the transverse direction, and has a width equal to the width of the main block 100. As an example, such a finishing block 300 may have a flat upper surface, and may have a third coupling groove which corresponds to the first coupling protrusion 110 and which is recessed from a lower surface of the finishing block 300. Therefore, by fitting the first protrusion 110 of the main block 100 positioned below the finishing block 300 into the third coupling groove of the finishing block 300, an aesthetic external appearance is capable of being realized.

Figure 5A:
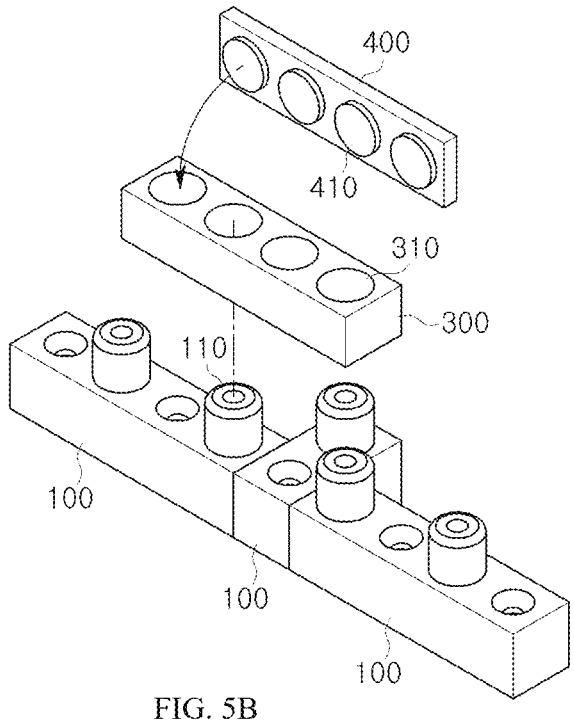
FIGS. 5A, 5B, and 6 show a process of assembling using a finishing block and a finishing plate applied to the structure for assembly-type furniture of the present disclosure.
Figure 5B:
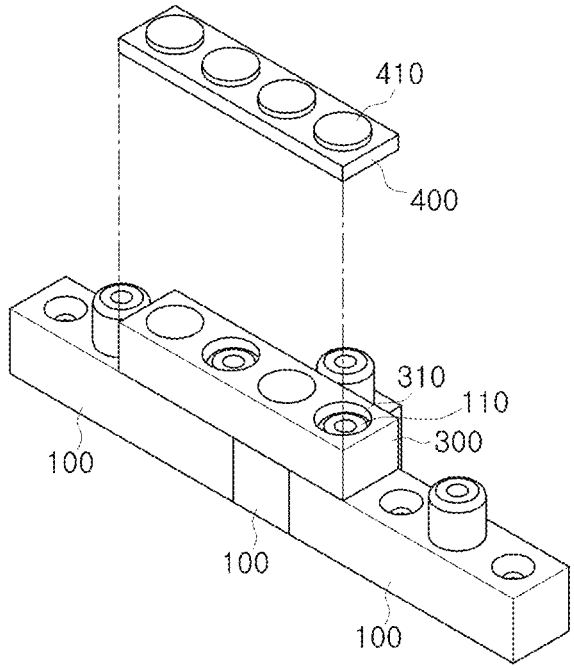
Figure 6:
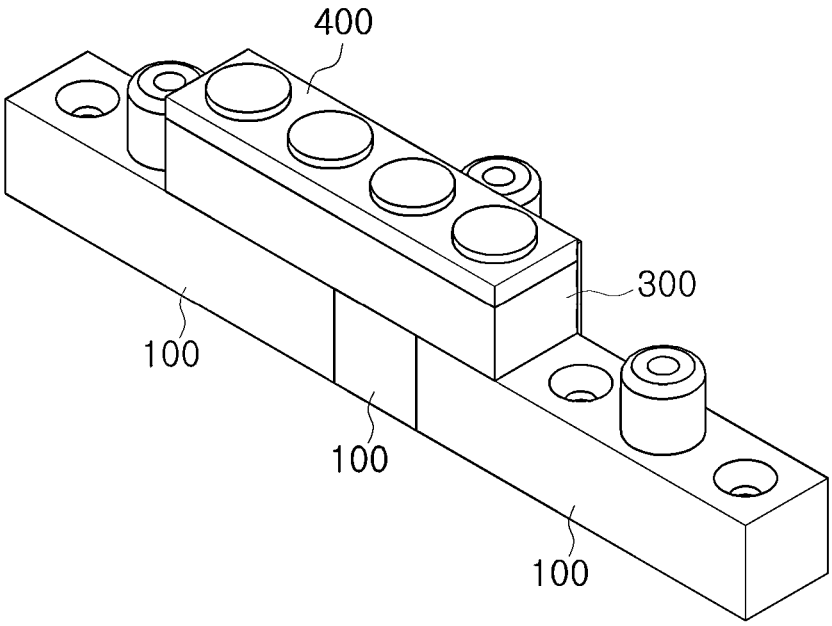

In addition, as another example, a third coupling hole 310 corresponding to the first coupling protrusion 110 may be formed through the finishing block 300 as illustrated in FIGS. 5A and 5B. When the first coupling protrusion 110 of the main block 100 positioned below the finishing block 300 is fitted into the third coupling hole 310, an upper surface of the first coupling protrusion 110 is exposed to the outside, so that the finishing plate 400 is capable of being coupled to the upper side of the finishing block 300. At this time, it is preferable that the finishing block 300 is formed such that the finishing block 300 has a height higher than the height of the first coupling protrusion 110 so that a coupling space in which the finishing plate 400 is capable of being coupled to an upper end part of the third coupling hole 310 is formed when the first coupling protrusion 110 is fitted into the third coupling hole 310.

As an example, the finishing plate 400 may be formed in a plate shape having a length and a width corresponding to those of the finishing block 300, and a fourth coupling protrusion part 410 that is to be fitted into the upper end part of the third coupling hole 310 may protrude from a lower surface of the finishing plate 400. Therefore, as illustrated in FIGS. 5A, 5B, and 6, among the stacked main blocks 100, the finishing block 300 is assembled on the upper side of the main block 100 positioned at the uppermost side, and then the finishing plate 400 is assembled on the upper side of the finishing block 300, so that the aesthetic external appearance is capable of being realized. In addition, the finishing block 300 may be formed such that the fourth coupling protrusion parts 410 protrude from opposite surfaces of the finishing block 300 so that a user can easily assemble the finishing block 300 without distinguishing between the upper surface and the lower surface of the finishing block 300.

Figure 7:
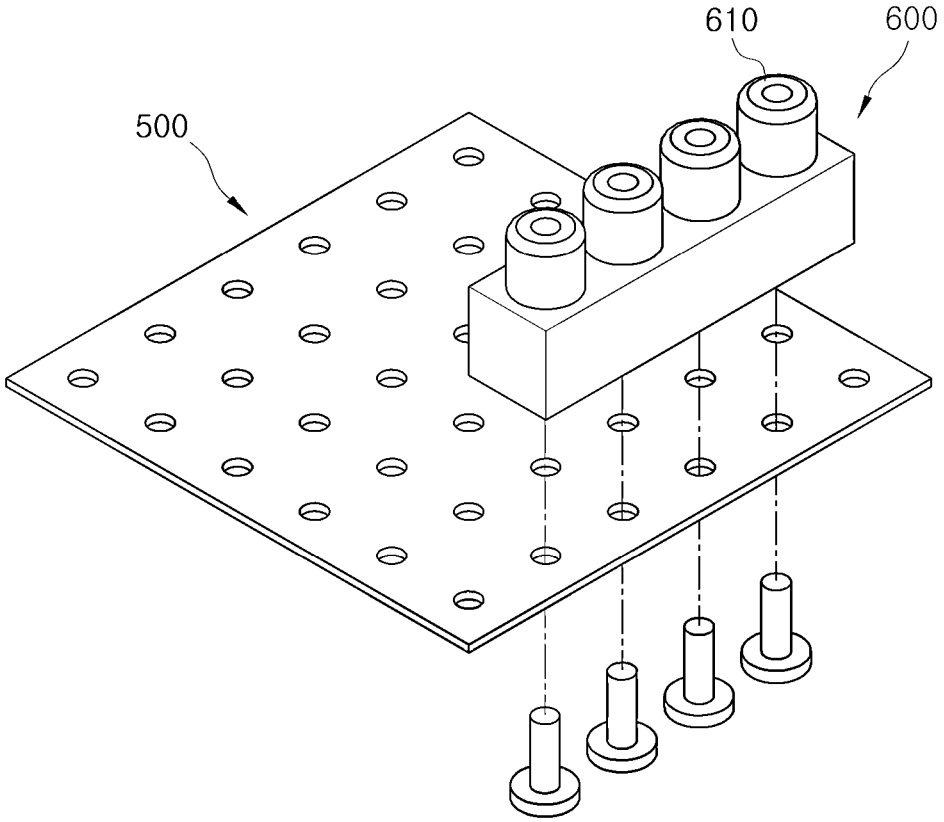
FIG. 7 is a view illustrating a process of assembling a base plate and a base block applied to the structure for assembly-type furniture of the present disclosure.

Meanwhile, in order to manufacture various types of assembly-type furniture, the present disclosure may further include a base plate 500 for stacking the plurality of main blocks 100. As illustrated in FIG. 7, the base plate 500 may be formed in a plate shape, the plurality of main blocks 100 is capable of being stacked on an upper side of the base plate 500 while the plurality of main blocks 100 is in a fixed state, and the base plate 500 may be perforated so as to fix blocks with bolts. The main block 100 may be directly fixed to the base plate 500, or may be indirectly fixed to the base plate 500 through the base block 600.

As illustrated in FIG. 7, it is preferable that the base block 600 is formed in a bar shape, is disposed in the transverse direction, and has a width equal to the width of the main block 100. Such a base block 600 may have a fifth protrusion 610 that protrudes from an upper surface of the base block 600 so as to be coupled to the main block 100, and may have a screw groove formed upward from a lower surface of the base block 600 for fastening a bolt thereinto so as to couple the base block 600 to the base plate 500. At this time, the fifth coupling protrusion 610 may include a plurality of fifth coupling protrusions 610 formed adjacent to each other along a longitudinal direction so as to rigidly fix the main block 100, and the plurality of fifth coupling protrusions 610 may be respectively fitted into the first coupling groove 120 and the auxiliary coupling groove 150.

Figure 8:
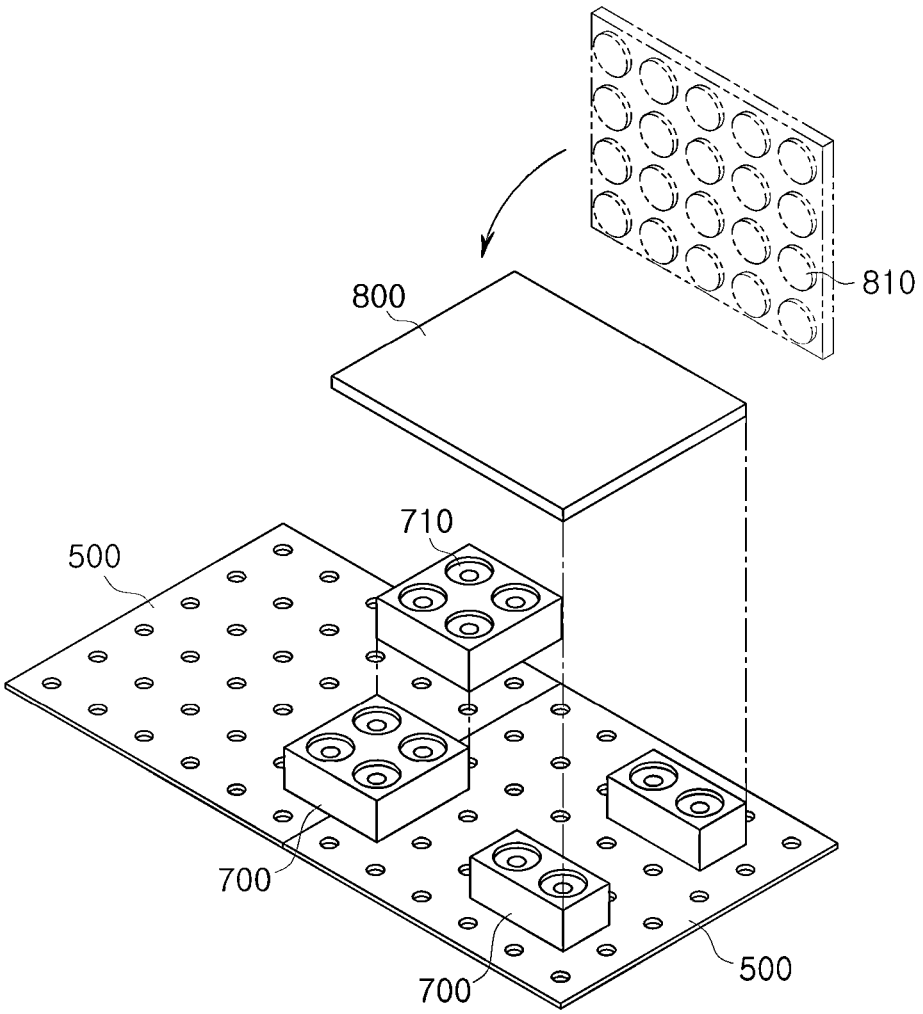
FIG. 8 and FIG. 9 are views illustrating a process of assembling using the base plate, a support block, and a support plate applied to the structure for assembly-type furniture of the present disclosure.
Figure 9:
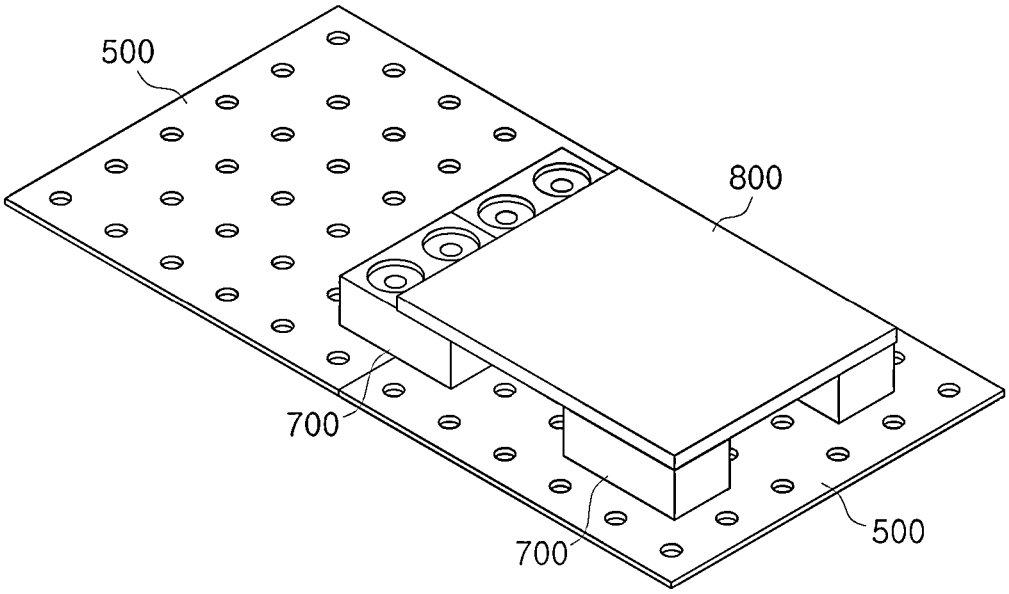
Figure 10:
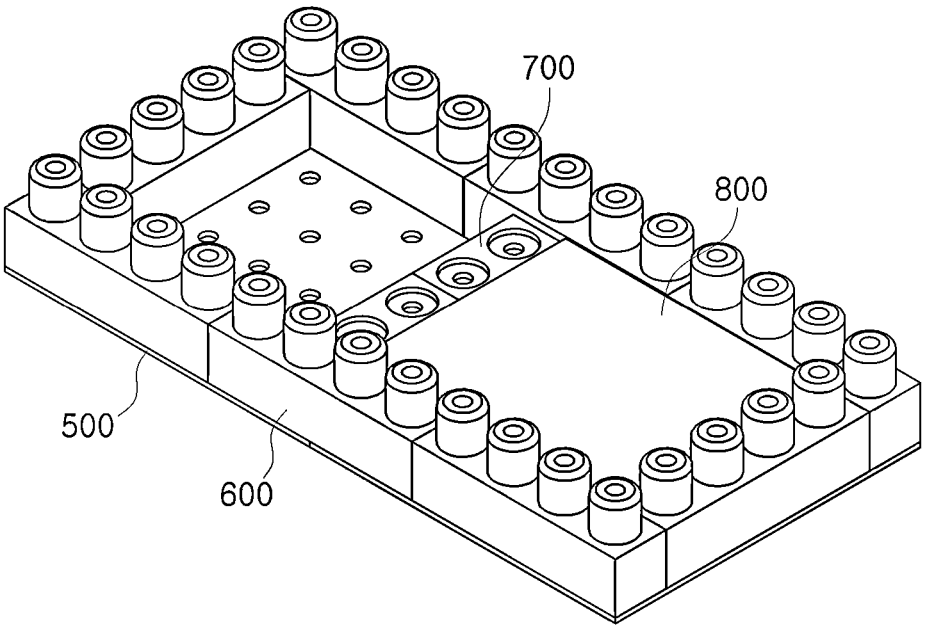
FIG. 10 is a view illustrating a state in which the base plate, the base block, the support block, and the support plate applied to the structure for assembly-type furniture of the present disclosure are used and assembled.

In addition, although the base plate 500 that is perforated may be used as a floor, a wall body, and so on of furniture, using the perforated base plate 500 as a floor or a wall body according to the purpose of furniture, the type of items to be stored, and so on may cause inconveniences such as the inflow of foreign substances. Therefore, as illustrated in FIG. 8 to FIG. 10, the present disclosure may further include a support block 700 for fixing the support plate 800 to the base plate 500.

First, the support block 700 may be formed in a bar shape disposed in the transverse direction or in a plate shape having a predetermined thickness, and a screw groove may be formed from a lower surface of the support block 700 for fastening a bolt thereinto so as to couple the support block 700 to the base plate 500. Such a support block 700 may serve to connect a plurality of base plates 500 disposed on the same plane. In addition, the support block 700 may have a sixth coupling groove 710 that is recessed from an upper surface of the support block 700 so as to couple the support block 700 to the support plate 800. The support plate 800 may be formed in a plate shape, and may have a seventh coupling protrusion part 810 which protrudes from a lower surface of the support plate 800 and which is capable of being forcibly-fitted into the sixth coupling groove 710 so as to couple the support plate 800 to the support block 700.

Figure 11:
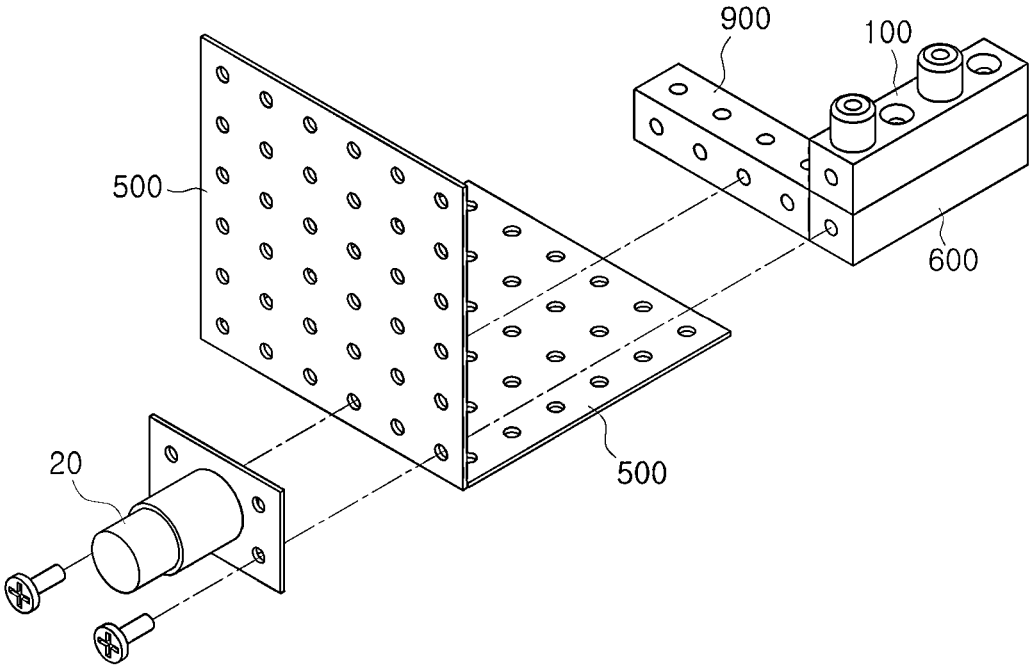
FIGS. 11, 12A, and 12B show a process in which two base plates disposed orthogonally to each other are coupled to each other by a connection block applied to the structure for assembly-type furniture of the present disclosure and a leg member is coupled to one of the two base plates.
Figure 12A:
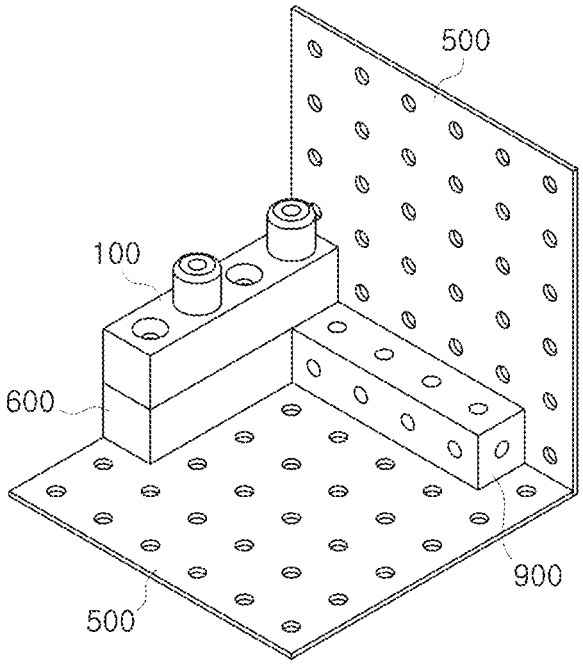
Figure 12B:
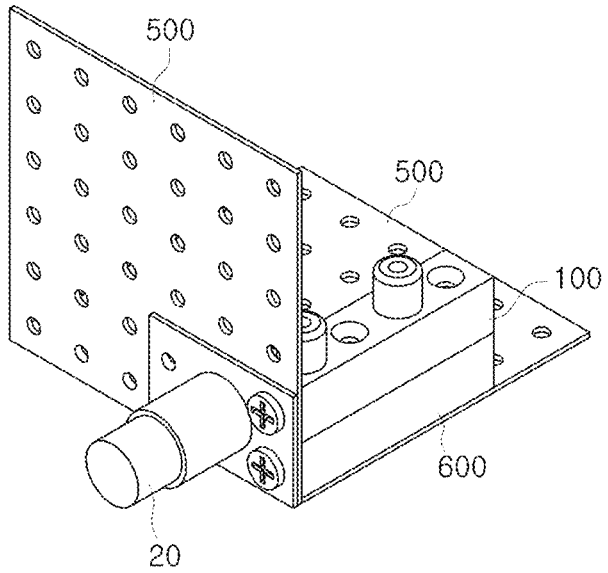

Meanwhile, assembly-type furniture may be manufactured by connecting two base plates 500 to each other so that the two base plates 500 are orthogonal to each other for mounting a leg member 20 and so on. To this end, as illustrated in FIGS. 11, 12A, and 12B, the present disclosure may further include a connection block 900 connecting two base plates 500 that are disposed orthogonally to each other. As an example, the connection block 900 may be formed in a bar shape and may be disposed in the transverse direction, may have a screw groove in a first surface of the connection block 900 in contact with one base plate 500 for screw-coupling, and may have a screw groove in a second surface of the connection block 900 in contact with another base plate 500 for screw-coupling. The screw grooves may be formed in groove shapes, and also may be formed in hole shapes. In addition, the connection block 900 may further have a screw groove formed in at least one of opposite ends in a longitudinal direction thereof for screw-coupling. In addition, screw grooves for screw-coupling to two base plates 500 disposed orthogonally to each other may be formed also in the main block 100, the finishing block 300, and the base block 600 described above.

Figure 13:
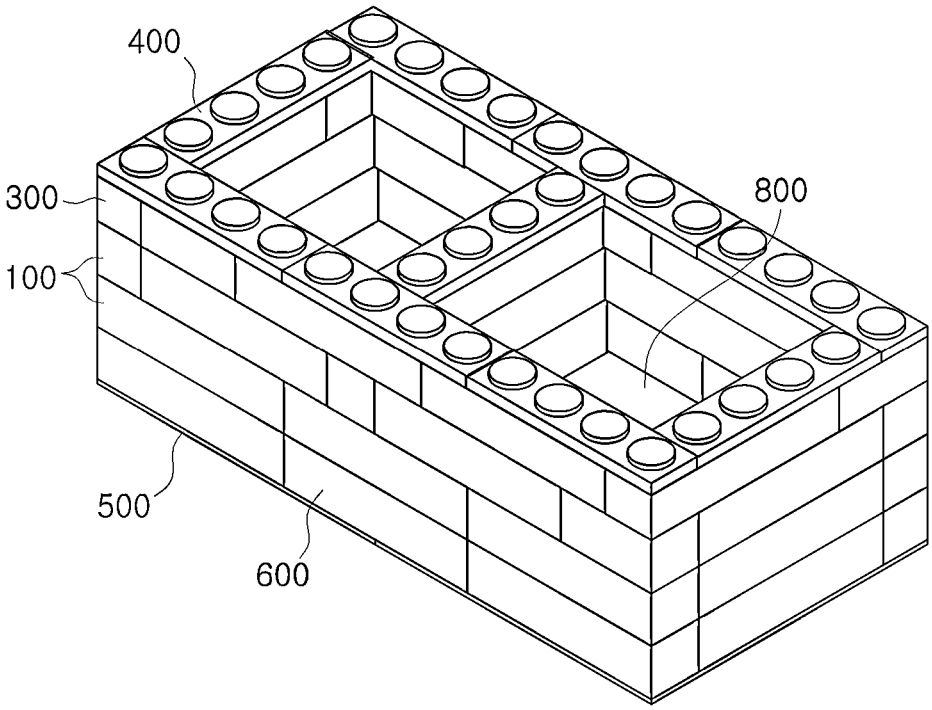
FIG. 13 is a view illustrating an example of assembly-type furniture manufactured by using the structure for assembly-type furniture.

In the present disclosure, as illustrated in FIG. 13, in addition to the main block 100, the auxiliary fastening member 200, the finishing block 300, the finishing plate 400, the base plate 500, the base block 600, the support block 700, the support plate 800, the connection block 900, and so on are capable of being additionally used, so that various types of assembly-type furniture are capable of being manufactured.

DESCRIPTION OF REFERENCE NUMERALS

| | |
|---|---|
| 10: Fixing bolt | 20: Leg member |
| 100: Main block | 110: First coupling protrusion |
| 120: First coupling groove | 130: Receiving groove |
| 140: Fixing hole | 150: Auxiliary coupling groove |
| 200: Auxiliary fastening member | 210: Second coupling protrusion part |
| 220: Second pin part | |
| 300: Finishing block | 310: Third coupling hole |
| 400: Finishing plate | 410: Fourth coupling protrusion part |
| 500: Base plate | |
| 600: Base block | 610: Fifth coupling protrusion |
| 700: Support block | 710: Sixth coupling groove |
| 800: Support plate | 810: Seventh coupling protrusion part |
| 900: Connection block | |

The invention claimed is:

1. A structure for assembly-type furniture, the structure comprising:

a plurality of main blocks, wherein each main block of the plurality of main blocks is formed in a bar shape and disposed in a transverse direction, the each main block having at least one first coupling protrusion that protrudes from an upper surface of the each main block, and at least one first coupling groove that is recessed from a lower surface of the each main block, in a shape corresponding to the first coupling protrusion, the first coupling protrusion and the first coupling groove being longitudinally offset from one another so as not to be vertically overlapping within the each main block;

wherein each first coupling protrusion includes a threaded fastening hole formed along a longitudinal axis of the protrusion;

wherein the each main block further includes a receiving groove recessed from the upper surface at a location corresponding to the first coupling groove and a fixing hole extending through the receiving groove;

wherein the each main block further includes an auxiliary coupling groove formed in a shape corresponding to that of the first coupling protrusion and recessed from the lower surface at a location directly beneath the first coupling protrusion;

wherein the plurality of main blocks include a first main block and a second main block that is vertically adjacent to the first main block in a stacked state, and the first coupling protrusion of the first main block is fitted into the first coupling groove of the second main block;

wherein the structure further comprises a fixing bolt that passes through the fixing hole of the second main block with a head portion seated within the receiving groove of the second main block and is threadedly engaged with the fastening hole of the first coupling protrusion of the first main block, the fixing bolt having a length less than a height of the first coupling protrusion; and wherein the head portion of the fixing bolt and the receiving groove of the each main block are configured such that the fixing bolt does not protrude from the upper surface of the each main block.

2. The structure of claim 1, further comprising: an auxiliary fastening member that comprises a second coupling protrusion part formed in a shape same as that of the first coupling protrusion and configured to be positioned on the upper surface of the each main block and a second pin part that extends downward from the second coupling protrusion part and that passes through the fixing hole where the fixing bolt is capable of passing therethrough.

3. The structure of claim 1, further comprising:

a finishing block having a third coupling groove that corresponds to the first coupling protrusion and that is recessed from a lower surface of the finishing block or having a third coupling hole formed through the finishing block; and a finishing plate having a fourth coupling protrusion part configured to be fitted into an upper end of the third coupling hole, the finishing block having a height greater than the height of the first coupling protrusion to provide a coupling space for the finishing plate.

4. The structure of claim 1, further comprising:

a base plate configured such that the plurality of main blocks is are capable of being stacked on an upper side of the base plate while the plurality of main blocks is are in a fixed state; and a base block formed in a bar shape wherein the base block comprises a fifth protrusion that protrudes from an upper surface of the base block so as to be coupled to the each main block, and a screw groove formed upward from a lower surface of the base block for fastening a bolt thereinto so as to couple the base block to the base plate.

* * * * *